US006394818B1

(12) United States Patent
Smalley, Jr.

(10) Patent No.: US 6,394,818 B1
(45) Date of Patent: May 28, 2002

(54) POWER CONNECTOR

(75) Inventor: Jared Joseph Smalley, Jr., Harrisburg, PA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/819,302

(22) Filed: Mar. 27, 2001

Related U.S. Application Data

(63) Continuation-in-part of application No. 09/841,696, filed on Apr. 24, 2001.

(51) Int. Cl.[7] ..... H01R 13/10

(52) U.S. Cl. ..... 439/79; 439/682; 439/181; 439/752.5

(58) Field of Search ..... 439/79, 682, 862, 439/924.1, 752.5, 677, 181

(56) References Cited

U.S. PATENT DOCUMENTS 5,158,471 A * 10/1992 Fedder et al. ..... 439/80
5,342,220 A * 8/1994 Kodama ..... 439/181
5,564,952 A * 10/1996 Davis ..... 439/682
5,951,331 A * 9/1999 Li-Ming et al. ..... 439/682
6,135,790 A * 10/2000 Huang et al. ..... 439/79
6,217,356 B1 * 4/2001 Davis et al. ..... 439/181

* cited by examiner

*Primary Examiner*—Gary Paumen
(74) *Attorney, Agent, or Firm*—Wei Te Chung

(57) ABSTRACT

An electrical power connector (1) for use in a circuit board or backplane system comprises an insulative housing (10) defining a chamber (18) and an opening (11) communicating with the chamber, and a pair of separated conductive contacts (20) received in the chamber. A pair of protrusions (12) extend from opposite sides of the opening. Each contact includes a contact plate (21), a pair of longer contact fingers (242) and a pair of shorter contact fingers (244) between the longer fingers both extending from a front side of the contact plate and form longer and shorter contact sections (245, 247), respectively. Outside surfaces (2452, 2472) of the contact sections are gold plated for conductively contacting against a corresponding receptacle contact of a receptacle connector. The contact plate forms a blocking tab (25) extending in a direction opposite to the plated outside surfaces for insertion between the protrusions of the housing.

1 Claim, 5 Drawing Sheets

POWER CONNECTOR

CROSS-REFERENCE TO RELATED APPLICATIONS

This application is a continuation-in-part of U.S. patent application Ser. No. 09/841,696, filed Apr. 24, 2001.

BACKGROUND OF THE INVENTION

1. Field of the Invention

The present invention relates to a power connector, and particularly to a power connector having improved contacts.

2. Description of Prior Art

Commonly, an electronic power connector system is used in circuit board or backplane interconnection systems and comprises a power plug connector and a power receptacle connector mated with the plug connector. The power plug connector comprises a plurality of logic or signal plug contacts and power plug contacts to mate with respective signal receptacle contacts and power receptacle contacts of the receptacle connector, respectively, for transmitting logic signals and power between two circuit boards or backplanes. Such power connectors are disclosed in U.S. Pat. No. 5,158,471 and EP No. 0951102 A2. Referring to FIG. 6, a one-piece plug contact 60 disclosed in the EP No. 0951102 A2 for use in a power connector comprises a pair of contact plates 62 and a pair of bridging portions 64 linking the two contact plates 62 together. Each contact plate 62 comprises a pair of contact fingers 66 forming a converging extending, arcuate contact section 67 gold plated for conductively contacting against the receptacle contact. Additionally, a plurality of posts 68 depend from a bottom edge of the contact plate 62 for soldering to a circuit board (not shown). However, the plated layers on the contact sections 67 are easily broken off during hot plugging into the receptacle connector since they are relative thin, thereby adversely affecting the conductive connection between the plug and receptacle contacts. Additionally, the plug contact 60 is formed by being stamped from a conductive plate and then being folded along the bridging portions 64 thereof, therefore the manufacturing process thereof is relatively complicated.

Hence, an electronic power connector having improved plug contacts is required to overcome the disadvantages of the prior art.

BRIEF SUMMARY OF THE INVENTION

A first object of the present invention is to provide an electrical power connector having improved conductive contacts which provide improved electrical interconnection with receptacle contacts of a receptacle connector.

A second object of the present invention is to provide an electrical power connector having improved conductive contacts which are easily manufactured and low in cost.

An electrical power connector for use in a circuit board or backplane system comprises an insulative housing defining a chamber and an opening opened in a front wall thereof and communicating with the chamber, and a pair of separated conductive contacts received in the chamber. A pair of protrusions extend from opposite sides of the front wall into the opening. Each contact includes a contact plate, a pair of longer contact fingers and a pair of shorter contact fingers between the longer contact fingers both extending from a front side of the contact plate and form longer and shorter contact sections, respectively. Outside surfaces of the contact sections are gold plated for conductively contacting against a corresponding receptacle contact of a receptacle connector. The contact plate forms a blocking tab extending at a right angle from a rear edge thereof in a direction opposite to the plated outside surfaces for insertion between the protrusions of the housing.

Other objects, advantages and novel features of the invention will become more apparent from the following detailed description of the present embodiment when taken in conjunction with the accompanying drawings.

DETAILED DESCRIPTION OF THE INVENTION

Figure 1:
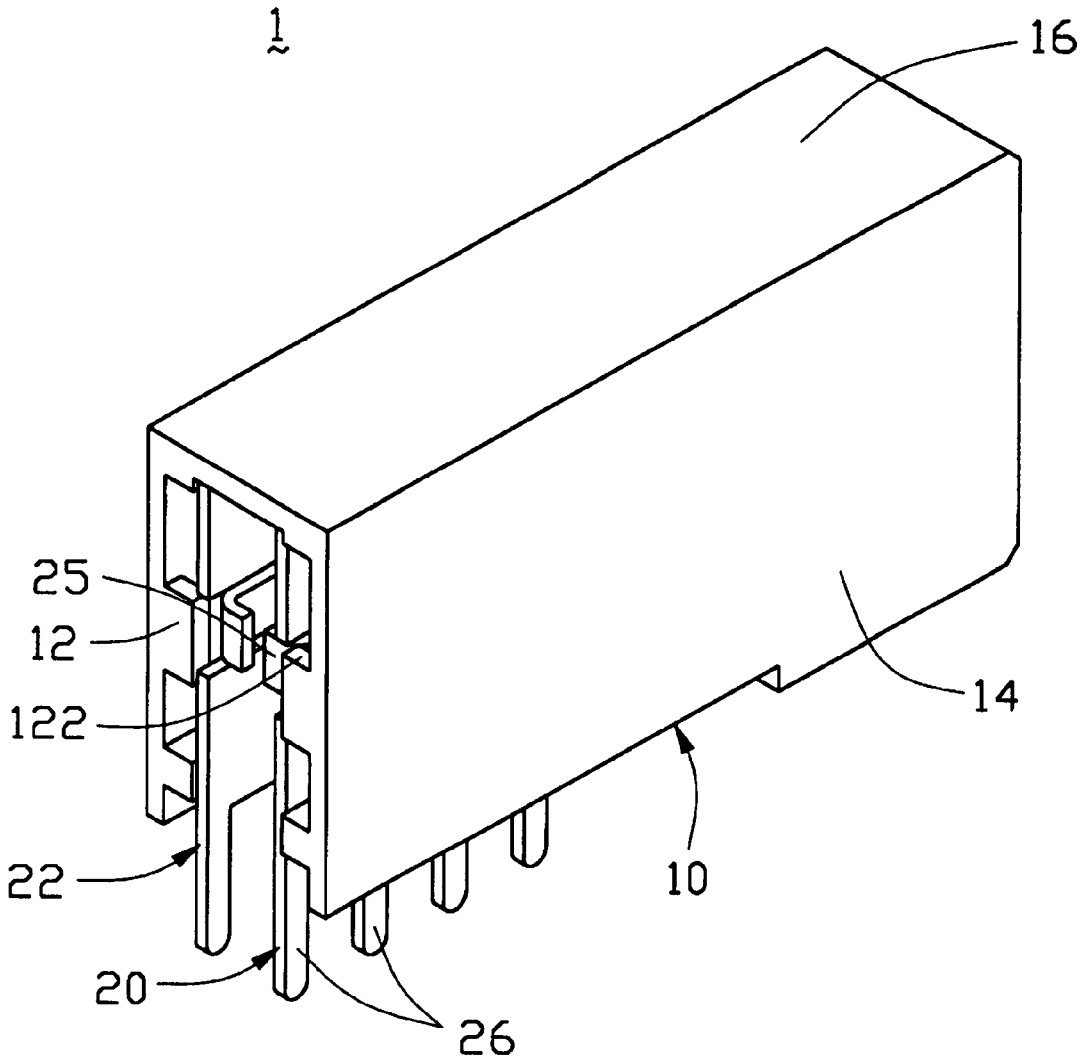
FIG. 1 is an assembled perspective view of an electrical power connector in accordance with the present invention.
Figure 2:
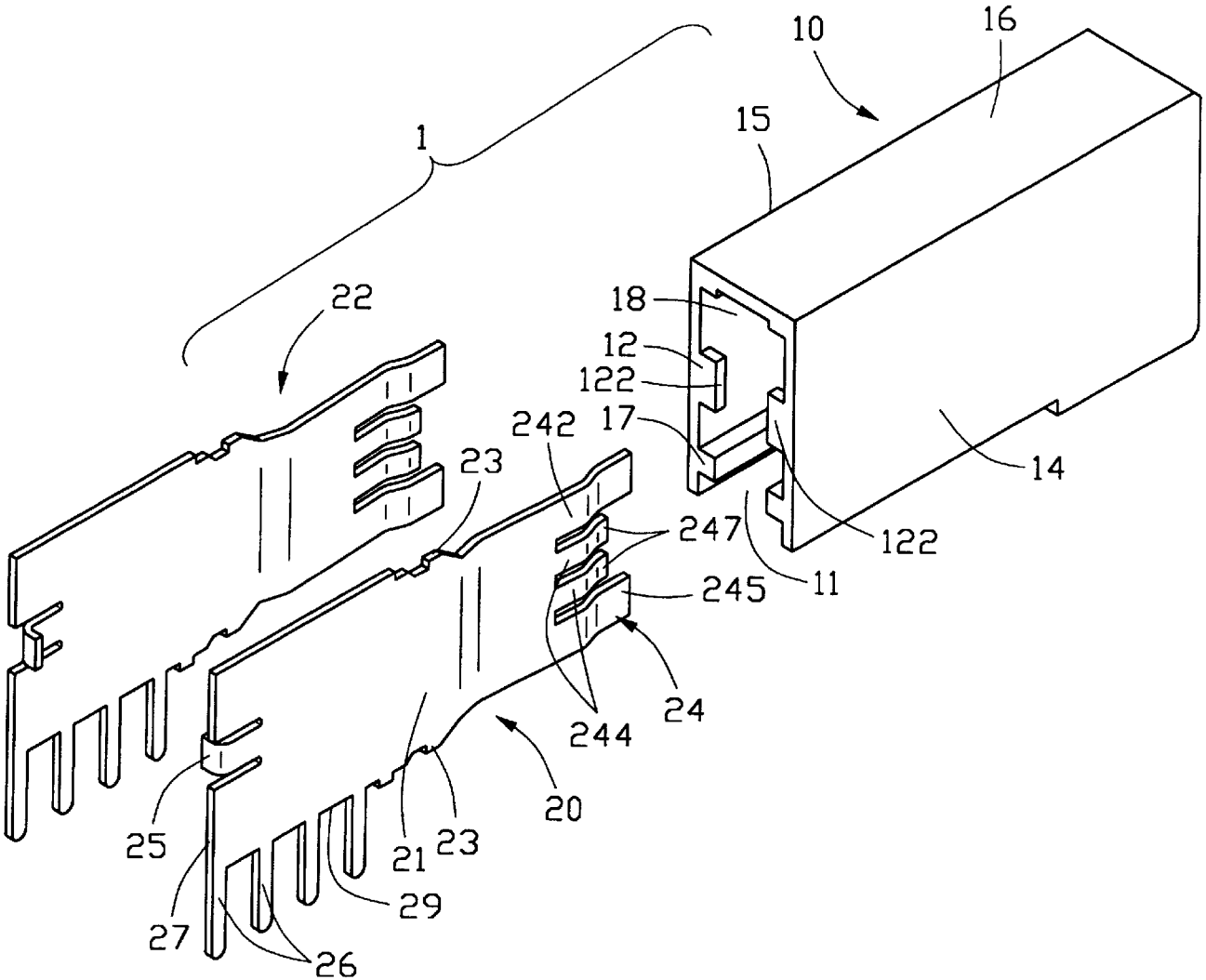
FIG. 2 is an exploded perspective view of FIG. 1.

Referring to FIGS. 1 and 2, an electronic power connector, 1 for use in a circuit board or backplane system is shown. The power connector 1 comprises an elongated dielectric housing 10 and a pair of left and right conductive contacts 20 and 22 received in the housing 10.

The housing 10 comprises a front wall 12, a pair of right and left side walls 14, 15 and a top wall 16 which cooperatively define a chamber 18 for receiving the conductive contacts 20 therein. The front wall 12 defines an opening 11 in a predetermined width and communicating with the chamber 12 for insertion of the contacts 20 and 22. A pair of protrusions 122 facing with each other extend from opposite edges of the front wall 12 toward the center plane of the chamber 18, and each protrusion 122 has a predetermined width. Additionally, the side walls 14, 15 form a pair of elongated bars 17 extending toward each other from lower portions of the opposite inner surfaces thereof for retaining the contacts 20, 22.

Figure 3:
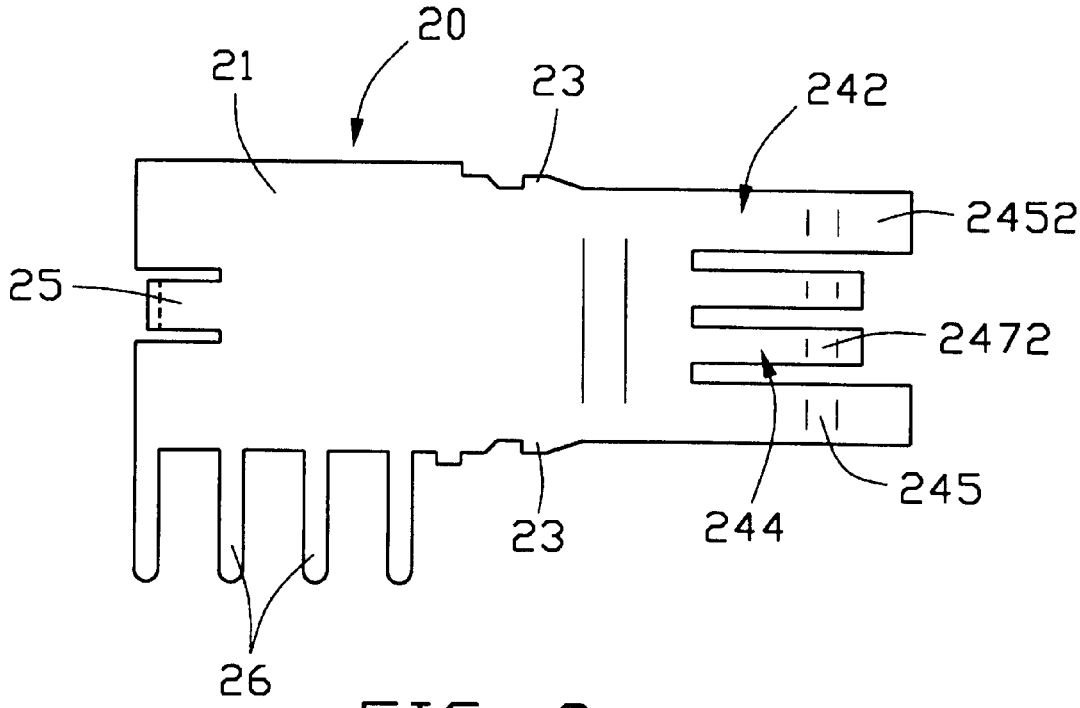
FIG. 3 is a front view of a conductive contact of FIG. 2.
Figure 4:
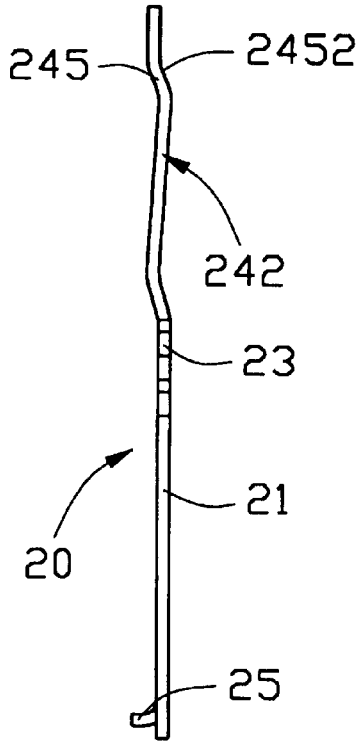
FIG. 4 is a top view of the conductive contact of FIG. 2.

Referring to FIGS. 2–4, the right and left contacts 20, 22 have symmetric structures about each other for respectively inserting into right and left sides of the chamber 18, and thus only the right contact 20 is detailed described below. The right contact 20 forms a conductive plate 21, a plurality of contact fingers 24 extending forward from the conductive plate 21 and a plurality of posts 26 depending downward from a lower edge 29 of the plate 21 for soldering to a circuit board (not shown). The conductive plate 21 forms a pair of barbs 23 on both upper and lower edges thereof for being interferingly retained in the housing 10. In addition, a blocking tab 25 projects inward from a rear edge 27 of the conductive plate 21 at a right angle. The contact fingers 24 comprise a pair of outer longer contact fingers 242 and a pair of relative inner shorter contact fingers 244 between the longer ones 242. The longer and shorter contact fingers 242, 244 respectively form a pair of longer and a pair of shorter contact sections 245, 247 both convergingly extending in a same direction. Outside surfaces 2452, 2472 of the contact sections 245, 247 are gold plated for contacting against a corresponding receptacle contact of the receptacle connector (not shown), thereby providing more contact points than those of the prior art to improve interconnection between the contacts 20, 22 and the receptacle contact. In addition, during hot plugging into the receptacle connector, the longer contact sections 245 of the longer fingers 242 are firstly contacted the receptacle contact with respect to the shorter contact sections 247 of the shorter fingers 244. Therefore, the longer contact fingers 242 will take any damage produced from the hot engagement with the receptacle contact with at least the shorter fingers 244 remaining intact and workable. Thus, the electrical interconnectivity between the contacts 20, 22 and the receptacle contact is improved over that of the prior arts, as described above.

Figure 5:
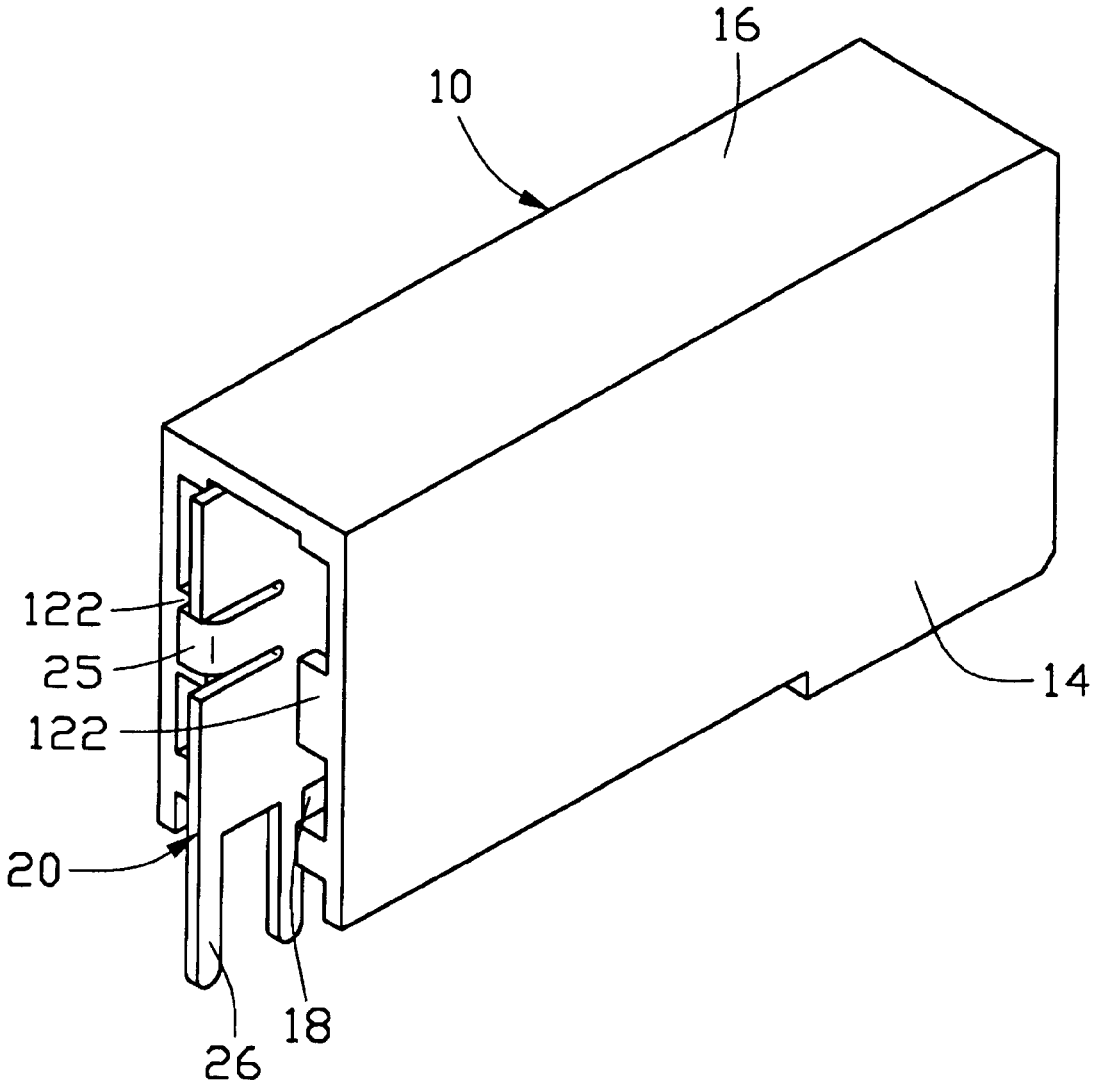
FIG. 5 is an assembled perspective view of a conductive contact erroneously assembled with a dielectric housing of the electrical connector of FIG 1.
Figure 6:
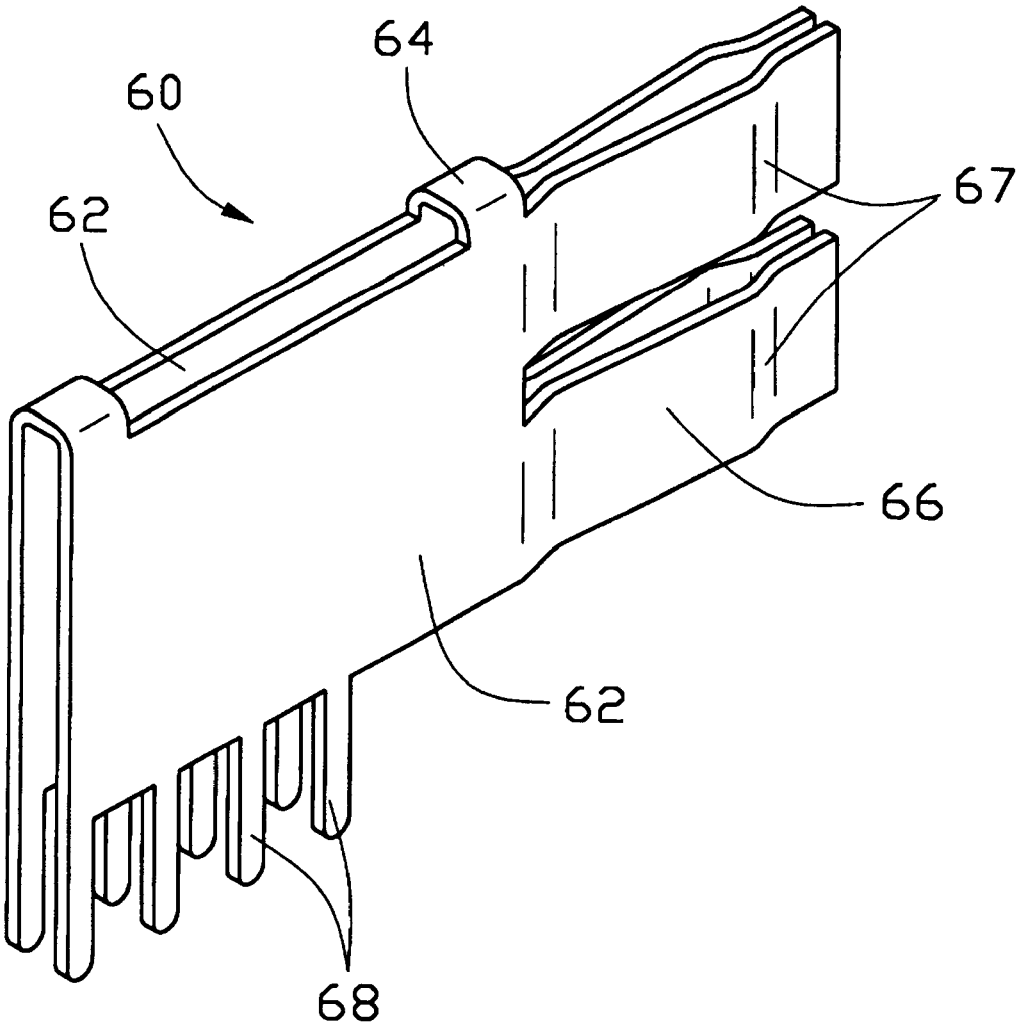
FIG. 6 (PRIOR ART)
FIG. 6 is a perspective view of a prior art conductive contact.

In assembly, referring to FIGS. 1 and 2, the right and left conductive contacts 20 are respectively inserted into the right and left sides of chamber 18 from the opening 111 of the housing 10 with the blocking tabs 25 thereof facing with each other. The conductive contacts 20 are securely retained in the housing 10 by the positioning bars 17 of the housing 10 and the barbs 23 thereof. At the same time, the blocking tabs 25 of the contacts 20 are face-to-face located between the protrusions 122 of the housing 10. In use, the power connector 1 is inserted into the receptacle connector with the plated outside surfaces 2452, 2472 of each contact 20/22 sequentially conductively contacting against the corresponding receptacle contact of the receptacle connector. In case the right or left conductive contact 20 is mistakenly inserted toward the left or right side of the chamber 18, for example, the right contact 20 is inserted toward the left side of the chamber 18, the blocking tab 25 thereof will be blocked off by a corresponding blocking protrusion 122 of the housing 10, as is shown in FIG. 5. Using such means, each of the contacts 20, 22 is prevented from being inserted into a wrong side of the chamber 18 so as to avoid non-plated outside surfaces of the contact fingers contacting against the corresponding receptacle contact.

It is to be understood, however, that even though numerous charasteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical power connector for use in a circuit board or backplane system, comprising:

an insulative housing defining a chamber, a front opening, and a pair of opposite side protrusions; and a pair of separated conductive contacts being received in the chamber, each contact having a contact plate, a pair of outer and longer contact fingers and a pair of inner and shorter contact fingers between the longer contact fingers, said pairs of longer and shorter contact fingers extending from a front side of the contact plate and respectively forming longer and shorter contact sections, outside surfaces of the longer and shorter contact sections being gold plated for conductively contacting against a corresponding receptacle contact of a receptacle connector, the contact plate forming a blocking tab extending in a direction opposite to the plated outside surfaces of the longer and shorter contact sections, the blocking tabs pointing toward each other and being situated between the protrusions of the housing;

wherein each of the protrusions of the housing extends into the opening and wherein each blocking tab extends inwardly at substantially a right angle from a rear edge of the contact plate and is located at a position substantially aligned with a respective protrusion of the housing;

wherein the longer and shorter contact sections of each contact extend convergingly toward those formed by the other contact;

wherein a pair of positioning bars extend into the chamber from opposite inner surfaces of side walls of the housing for retaining the pair of contacts.

* * * * *